United States Patent [19]

Locatelli

[11] 4,062,607

[45] Dec. 13, 1977

[54] CARD FILED BOX WITH OUTWARDLY OPENING FRONT AND REAR PANELS

[76] Inventor: John D. Locatelli, 3340 59th Ave. SW., Seattle, Wash. 98116

[21] Appl. No.: 673,210

[22] Filed: Apr. 2, 1976

[51] Int. Cl.[2] ..... A47B 57/08

[52] U.S. Cl. ..... 312/258; 312/290

[58] Field of Search ..... 217/5, 7, 62, 65; 190/12; 206/373; 312/244, 258, 259, 293, 324

[56] References Cited

U.S. PATENT DOCUMENTS

| | | | |
|---|---|---|---|
| 2,331,472 | 10/1943 | Holleck | 312/290 |
| 2,374,965 | 5/1945 | Weston | 312/290 |
| 2,605,617 | 8/1952 | Replogle | 312/258 |
| 2,936,066 | 5/1960 | Meksula | 312/324 |
| 3,434,769 | 3/1969 | Salet | 312/258 |

*Primary Examiner*—Casmir A. Nunberg

*Attorney, Agent, or Firm*—Graybeal, Barnard & Uhlir

[57] ABSTRACT

A card file box having front and rear panels pivotally mounted to open outwardly for increased capacity and ready accessibility to the cards contained therein. A bottom member has a trapezoidal shaped cross-section which provides a pair of angularly disposed edges adjacent the front and rear panels. A pair of coaxial pins are situated near the lower corners of each front and rear edge of a pair of end panels adjacent the bottom member and pivotally cooperate with mating openings in the lower edges of the front and rear panels. Outward travel of the front and rear panels is limited by contact between the lower portion of the inward surface of the front and rear panels and the angular edge of the bottom member. In the closed position the integrity of the box is maintained by a pair of upwardly facing projections on the top edges of the front and rear panels engaging mating openings on the lower surface of the top panel. The top panel is lifted vertically to free both the front and rear panels for outward pivotal movement thereby increasing the angular displacement between adjacent file cards.

6 Claims, 6 Drawing Figures

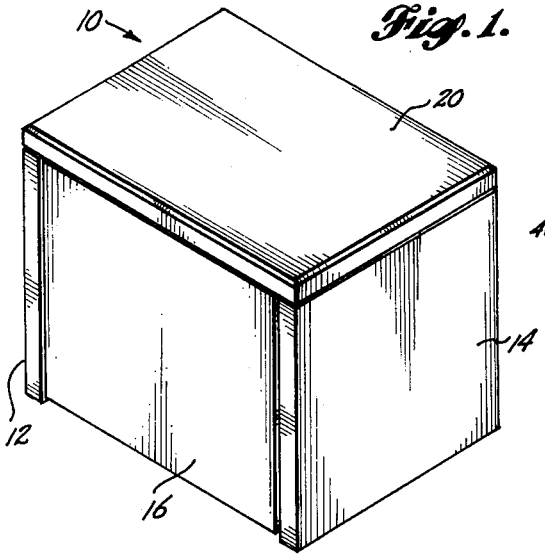
Fig. 1.
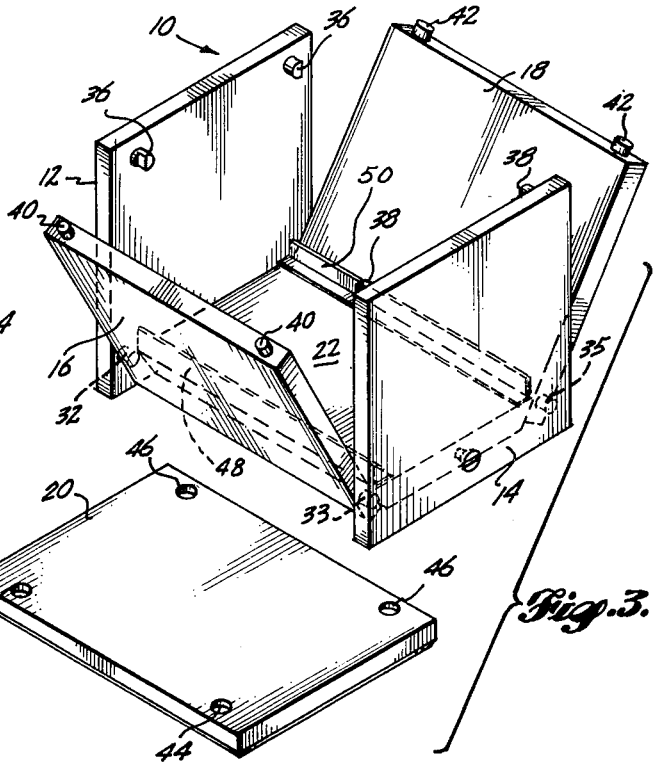
Fig. 3.
Fig. 2.
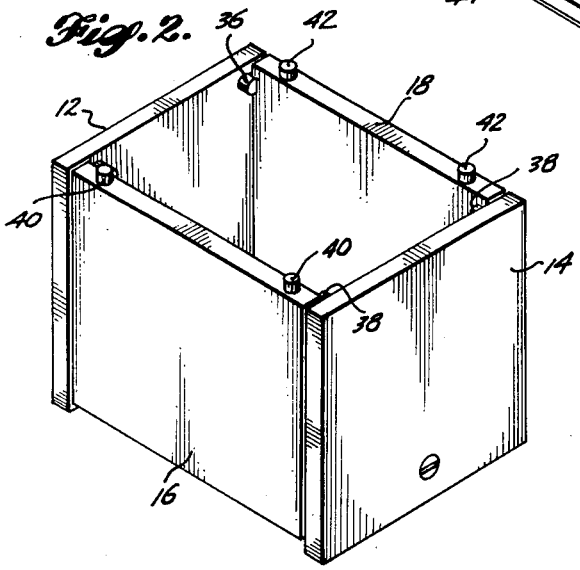
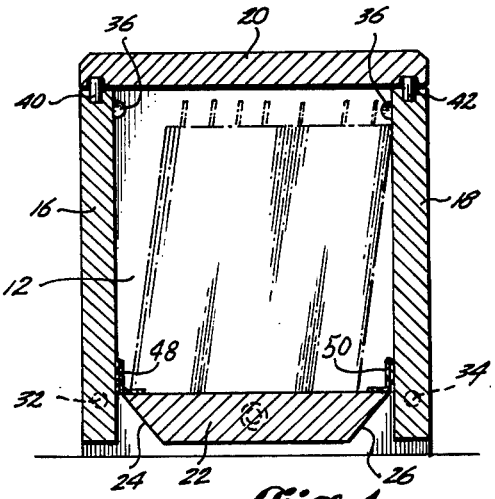
Fig. 4.
Fig. 5.
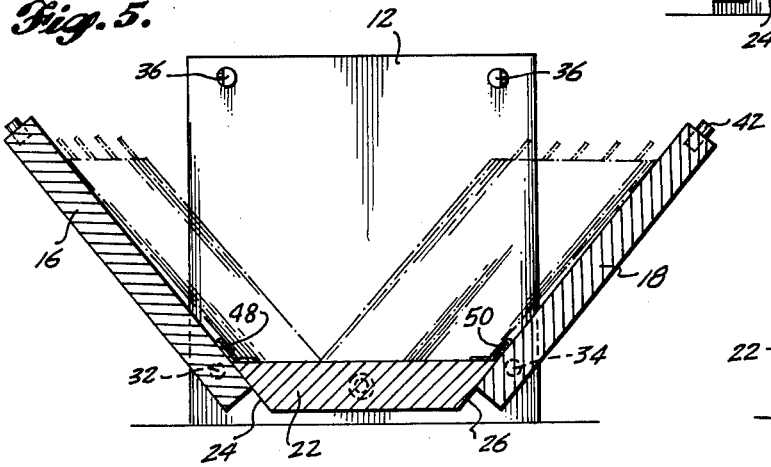
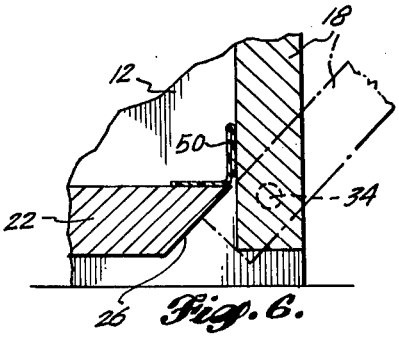
Fig. 6.

CARD FILED BOX WITH OUTWARDLY OPENING FRONT AND REAR PANELS

BACKGROUND OF THE INVENTION

1. Field of the Invention

This invention relates to a card file box and, more particularly, to a card file box having front and rear panels which pivot outwardly about their lower edge improving access to the file cards contained therein.

2. Description of the Prior Art

Card file boxes are generally known and commonly consist of a rectangularly shaped box with a flat bottom including fixed vertical ends joined by front and rear walls. Often a lid, either hinged or completely removable, is provided to completely enclose the box. In this type of box, file cards are most often situated to rest edgewise on the bottom of the box. In order to locate a specific card or cards within the card file box, index cards can be periodically interleaved to separate the file cards in smaller groups. Within each group the face of the card, or at least the top portion thereof, is normally visually examined to ascertain the subject matter of the card. This requires that there be few enough cards in the box to permit angular separation of adjacent cards so that each successive card is readily visible to the person using the card file. Otherwise each card must be at least partially withdrawn from the card file box if the user wishes to view each card.

Of particular interest is the card file box disclosed in L. C. Walker U.S. Pat. No. 2,258,666, disclosing a card file box in which a supplemental card supporting member is provided within the card box. Front and back portions are inclined at obtuse angles to the bottom portion of the supplemental card supporting insert. When an index card is selected it is shifted forward together with any card ahead of it leaving the space of the card in interest in view on the angularly inclined rear portion of the supplemental member. In such a box there is necessarily a significant amount of unused space within the card file box as the result of the inclined front and rear portions of the supplemental insert.

Of general interest, but not particularly relevant to the card file box of the present invention, are the disclosures of the following U.S. Pat. Nos.:

| | |
|---|---|
| Potter | 328,061 |
| McPherson | 644,300 |
| Adams | 815,670 |
| Steele | 1,123,417 |
| Blalock | 1,264,002 |
| Gelinas | 1,924,494 |
| Kennedy | 1,984,345 |
| Bentz | 2,044,661 |
| Kegevic | 2,744,621 |
| Meksula | 2,936,066 |

SUMMARY OF THE INVENTION

According to an aspect of the invention, an improved card file box is provided having front and rear panels pivotally mounted at their respective lower ends to a pair of fixed end panels. Openings on the underside of a top panel engage projections along the top edge of both front and rear panels to retain the card file box in its closed configuration. Removal of the top allows the front and rear panels to open outwardly for ready access to the file cards even when the closed box is completely filled with cards. The outward extent of travel of the front and rear panel is limited by the engagement of the lower inward surface of each front and rear panel with an adjacent inwardly angular edge of the bottom member.

According to another aspect of the invention, a card file box is provided which extends the file cards on outwardly opening front and rear panels in the open configuration thereof. The file cards rest against either the inclined front or rear panel making it unnecessary to hold the cards separated when viewing a single card, even if the card file box is full of file cards.

According to yet another aspect of the invention, a card file box is provided which can be fabricated at a low cost from a minimum number of basic and readily available stock materials. A single thickness of stock material can be used to form the top, end and front and rear panels. The stops and journal pins in the end panels are all formed from sections of doweling stock.

According to still another aspect of the invention, a card file box is provided which can be easily and rapidly assembled so that it is readily adaptable to do-it-yourself kit form. Final assembly only involves the positioning of the front and rear panels adjacent the bottom member and the attachment of the end panels to either end of the bottom member with a single screw.

According to another aspect of the invention, a card file box is provided in which the file cards are separable forwardly and rearwardly so that a single file card, or a group of file cards, can be readily removed or inserted within a sequenced group of file cards. The sequential order of the file cards is maintained without the need of tie rods or the like.

According to yet another feature of the invention, a card file box is provided with outwardly opening front and rear panels. The weight of the file cards against the front and rear panels and the ease of movement thereof can be simply controlled by the snugness of dowel pins, situated on the lower edges of each front and rear panel, in their mating openings on the inward side of each end panel.

According to still another aspect of the invention, a card file box is provided which has front and rear panels pivotally mounted between a pair of end panels by simple doweling pins thereby eliminating weighty and costly metallic hinges.

Other and additional advantages and features will be apparent from the following description taken in conjunction with the accompanying drawing.

BRIEF DESCRIPTION OF THE DRAWING

FIG. 1 is a perspective view of a card file box constructed in accordance with the instant invention and illustrating the closed configuration thereof;

FIG. 2 is a perspective view of the card file box with the top removed illustrating the upwardly facing projection along the top edge of the front and rear panels;

FIG. 3 is a perspective view of the card file box in the open position with the front and rear panels pivoted outwardly to their full extent of travel and illustrating the openings in the bottom surface of the top panel;

FIG. 4 is a cross-sectional side elevation view of an almost filled card file box in the closed position;

FIG. 5 is a cross-sectional side elevational view of the card file box in the open position and illustrating the angular separation between adjacent file cards; and FIG. 6 is an enlarged fragmentary view illustrating the angularly disposed rear edge of the bottom member and, in broken line, the lower portion of the rear panel abutting the rear edge of the bottom member in the open configuration.

DESCRIPTION OF THE PREFERRED EMBODIMENT

Referring initially to FIGS. 1–3, a card file box 10 is illustrated with a pair of identical rectangular end panels 12 and 14 disposed at opposite ends thereof. A rectangular front panel and rear panel 16 and 18, respectively, are interconnected between end panels 12 and 14. A removable top 20 is provided and, in the closed position, is coextensively situated along the upper edges of front and rear panels 16 and 18 and end panels 12 and 14.

Next referring to FIGS. 4 and 5, bottom member 22 has vertically planar ends which are secured to the respective sidewalls near the lower end of end panels 14 and 16. It will be seen that bottom member 22, when viewed from an end thereof, is trapezoidally shaped having its more narrow parallel surface at the bottom of card file box 10. Accordingly, front and rear angular faces 24 and 26 are formed along the front and rear edge, respectively, and are inwardly inclined from the upper to the lower surface of the bottom member 22.

A pair of inwardly directed journal pins 32 and 33 are coaxially mounted near the bottom of end panels 12 and 14, respectively, adjacent the upper portion of angular face 24. In a similar manner, journal pin 34 (FIG. 5) and journal pin 35 are coaxially mounted near the lower portion of end panels 12 and 14, respectively, adjacent the upper end of rear angular face 26. A pair of coaxial openings are provided at the lower portion of each side edge of front panel 16 and rear panel 18. Each opening is sized to pivotally cooperate with the respective inwardly projecting journal pin so that front panel 16 and rear panel 18 can be opened outwardly.

Now referring primarily to FIG. 2 in conjunction with FIG. 3, the outward pivotal movement of the front and rear panels is limited by the engagement of the lower portion of the front and rear panels with the respective angular edge face of bottom member 22. As is best seen in FIG. 6, rear panel 18 is disposed to pivot about its lower end along the axis of journal pins 32 and 34. At the most outward extent of travel, the lower portion of the inner surface or rear panel 18 contacts angular edge face 26 preventing further outward movement of the panel. Inwardly facing projections 36 and 38 are disposed near the upper portion of end panels 12 and 14, respectively, and are inwardly displaced from each vertical edge a distance approximately corresponding to the panel thickness. The inward pivotal movement of front and rear panels 16 and 18 is limited by the engagement of the inner surface of the respective panel with the projections protruding inwardly from end panels 12 and 14. Precise vertical alignment of front and rear panels 16 and 18 is obtained by cutting or shaving a cord-like segment from the cylindrical surface of the projections. Ideally, the distance between the outward surface of each projection and the outward edge of each end panel 12 and 14 would substantially correspond to the thickness of the front and rear panels.

In preferred form, top 20 retains card file box 10 in the closed configuration and prevents the outward pivotal movement of front and rear panels 16 and 18 thereby retaining the closed integrity of the file box. Referring again to FIGS. 3 and 4, a pair of upwardly facing projections 40 and 42 are provided in the upper edge of front panel 16 and rear panel 18. A mating pair of openings 44 and 46 (FIG. 3) are provided in the lower surface of top panel 20 near the front and rear edge thereof. As is seen in FIG. 4, in the closed position projections 40 and 42 extending upright along the top edges of the front and rear panels engage the internal sidewall of the openings on the underside of top 20 latching the pivotal panels in a vertical position.

The operation of the card file box is clearly illustrated in the drawings. As is best seen in FIG. 4, in the closed position a plurality of file cards are situated edgewise on bottom member 22. When top 20 is removed by lifting vertically, front panel 16 and rear panel 18 are free to pivot to their outer extent of travel. In this open configuration, adjacent file cards can be widely separated in order that the subject matter on the face of the card can be easily read. This is true even if the box is almost completely filled with file cards.

When a file card is selected, it is shifted toward rear panel 42 together with any file cards behind it, if there be any, to bring the face of the card toward the viewer. The file card or cards forward of it are left in an inclined position against front panel 16. Because of the wide angle between the file cards the full face of the exposed card can be easily observed. In addition, the exposed card will be maintained in view without the necessity of holding them in position by hand. However, a mere flip of the finger across the upward edges of the file cards allows selection of any of the remaining file cards.

In preferred form, a flexible strip 48 and 50 is provided along the full length of front and rear edge, respectively, of bottom member 22. In the closed configuration flexible strips 48 and 50 prevent the lower edge of the end file cards positioned in the card file box on the bottom member 22 from entering the gap located between the front and rear edge of bottom member 22 and the vertical front and rear panels. As illustrated in FIG. 6, one side of the strip has an adhesive substance thereon. About one-third of the width of the tape is used to secure the tape to the upper surface of bottom member 22 and the remaining two-thirds is lapped over so that it rests against the inward side of the adjacent vertically disposed panel.

A particular feature of this invention resides in its construction from basic and readily formed component parts. In one form, card file box 10 is constructed from wood. End panels 12 and 14 and front and rear panels 16 and 18 are formed from a length of wooden stock of the same thickness which, in preferred form, is about ½ inch thick. A single screw is used (together with interface glue, if desired) to hold end panels 12 and 14 to the vertically planar ends of bottom member 22. Of course, other methods of fastening can also be used. Inwardly projecting journal pins 32–35 are sections of doweling, as are the pairs of upward projections 40 and 42. The pairs of stops 36 and 38 mounted near upper end of end panels 12 and 14 are also sections of doweling and are ideally glued in openings formed in the respective end panels.

In preferred form, end panels 12 and 14 are about 4⅝ inches in width by about 4⅞ inches in height. Front and rear panels 16 and 18 are about 5½ inches in width by about 4⅝ inches in height. Top 20 is about 6½ inches in length by about 4¾ inches in width. The openings on the underside of top 20 are formed by a conventional method such as drilling or the like. Each opening is chamfered to assist in guiding the upward facing projections into their mating openings The construction of a card file box in the manner heretofore described is particularly well-suited to be adapted for sale in kit form and can be finally assembled easily and quickly by the user with only a conventional screwdriver. In such a do-it-yourself kit, the individual sections of doweling forming the journal pins and stops could either be already mounted in position on their respective panels or could be provided as a component part to be positioned in the mounting openings on the end panels. The rectangular planar nature of the component panels forming the card file box allows convenient packaging in a stacked fashion. Final assembly of the card file box would merely involve positioning of the front and rear panels adjacent each side of the bottom member and attachment of the end panels to the bottom member with a single screw.

A feature of the hereabove described construction of the instant card file box is that the ease of movement of the outwardly opening front and rear panels can be initially adjusted to prevent the front and rear panels from falling open when the top is removed. The ease of movement of the respective panels is controlled simply by varying the snugness of the doweling pins in the openings in the edge of front and rear panels 16 and 18. The precise diameter of each opening with respect to the diameter of the doweling pin varies the friction fit between the pin and opening sidewall and, hence, the freeness of the outward pivotal movement.

It should be understood that although, in preferred form, top 20 is separable and held in position by the upward projection disposed along the top edge of each front and rear panel, it could also be hinged to the upper portion of the rear panel. With this configuration, the component parts of the card file box according to the instant invention would be attached to each other so that top 20 could not become inadvertently misplaced.

While the card file box of the instant invention is fabricated in one form from wood, it should be understood that other material, and particularly plastic, is well-suited for forming of the individual component parts. If formed from plastic, the top, bottom, and front and rear panels can be formed in a single stop, including the stops and journal pins in each end panel, by any of the well-known processes, such as injection molding. Final assembly would then only involve positioning of the front and rear panels adjacent the bottom member and attachment of the end panels to opposite ends of the bottom member.

While it should be understood that the invention may embody other specific forms, the scope thereof is defined by the appended claims.

What is claimed is:

1. A card file box comprising:

a bottom panel with vertical planar ends and a substantially trapezoidal shaped cross-section providing angularly disposed edges at the sides thereof;

two rectangular end panels, each identical with the other;

means rigidly attaching said end panels to the ends of said bottom panel and placing said end panels in substantially vertical position;

rectangular front and rear panels, each identical to the other;

pin means situated near the bottom corners of the end panels and near the bottom corners of each front and rear panel, interconnecting the respective panels and allowing pivotal movement of each front and rear panel with respect to said bottom and end panels, said pin means being located adjacent the angularly disposed edges of said bottom panel so that the extent of outer pivotal movement of said front and rear panels is limited by engagement of the lower portion of said front and rear panels with the associated angularly disposed edges of the bottom panel;

inwardly facing end panel projections at the upper corners of said end panels engageable by upper corner portions of each front and rear panel to limit the extent of inward pivotal movement of said front and rear panels, with said front and rear panels being in closed, substantially vertical position when engaging said end panel projections;

upwardly facing projections at the corners of the top edges of said front and rear panels; and a top panel comprising recesses adjacent the corners thereof which interfit with the upwardly facing projections at the corners of each front and rear panel and thus retain the front and rear panels in closed position when said top panel is placed on top of said end and front and rear panels to fully close the box.

2. A card file box according to claim 1, wherein the outer surfaces of said end panels and said front and rear panels are substantially coextensive with the edges of said top panel in the closed configuration thereof.

3. A card file box according to claim 1, further including a pair of elongated flexible strips, each strip attached along the upper surface of said bottom panel adjacent one of said angularly disposed edges thereof, spanning the gaps between said bottom panel and said pivotally movable front and rear panels in the closed configuration thereof, so that cards disposed edgewise on said bottom panel are prevented from entering the gaps.

4. A card file box according to claim 1, wherein each said pin means comprises a pair of coaxially aligned inwardly facing mounting openings wherein each mounting opening is formed along the axis of said pin means near one of the bottom corners of said end panels; a short section of inwardly extending doweling mounted in each mounting opening; and a pair of coaxial openings disposed on the edge of one of said front and rear panels near the bottom corners thereof, each coaxial opening being sized to pivotally receive said inwardly extending dowels therein.

5. A card file according to claim 1, wherein said recesses adjacent the corners of the top panel are cylindrical openings which are chamfered along the bottom surface of said top panel thereby guiding said upwardly facing projections on said front and rear panels into the openings.

6. A card file box according to claim 1, wherein the angle of said angularly disposed edges at the sides of said bottom panel are approximately 45° from the vertical thereby allowing a substantial similar outward movement of each front and rear panel.

* * * * *